US010480185B1

(12) United States Patent
Attalla

(10) Patent No.: US 10,480,185 B1
(45) Date of Patent: Nov. 19, 2019

(54) SUPPORT WALL FRAME SYSTEM AND ASSOCIATED USE THEREOF

(71) Applicant: Anthony Attalla, Navarre, FL (US)

(72) Inventor: Anthony Attalla, Navarre, FL (US)

( * ) Notice: Subject to any disclaimer, the term of this patent is extended or adjusted under 35 U.S.C. 154(b) by 0 days.

(21) Appl. No.: 15/942,458

(22) Filed: Mar. 31, 2018

(51) Int. Cl.
*E04B 2/60* (2006.01)
*E04C 3/32* (2006.01)
*E04B 2/78* (2006.01)
*E04B 2/76* (2006.01)

(52) U.S. Cl.
CPC ..... *E04B 2/60* (2013.01); *E04B 2/767* (2013.01); *E04B 2/789* (2013.01); *E04C 3/32* (2013.01); *E04B 2103/06* (2013.01)

(58) Field of Classification Search
CPC ..... E04B 2/60; E04B 2103/06; E04B 2001/2424; E04B 2/789; E04B 2/58; E04B 2/7457; E04C 3/32; E04C 2003/0473; E04C 2003/0421; E04C 2003/0465; E04C 3/07; E04C 2/384
USPC ..... 52/781.3, 845, 836, 653.1, 655.1, 242, 52/293.3
See application file for complete search history.

(56) References Cited

U.S. PATENT DOCUMENTS 3,845,601 A * 11/1974 Kostecky ..... E04B 1/2403 403/242
4,805,364 A * 2/1989 Smolik ..... E04B 1/5818 52/241
4,809,476 A * 3/1989 Satchell ..... E04B 1/5818 52/241
4,854,096 A * 8/1989 Smolik ..... E04B 2/767 52/241
4,918,899 A * 4/1990 Karytinos ..... E04B 1/24 403/230
5,157,883 A * 10/1992 Meyer ..... E04B 2/766 24/460
5,203,132 A * 4/1993 Smolik ..... E04B 2/7409 403/230
5,315,804 A 5/1994 Attalla
5,325,651 A * 7/1994 Meyer ..... E04B 2/766 52/243
5,394,665 A * 3/1995 Johnson ..... E04B 2/766 52/105
6,374,558 B1 * 4/2002 Surowiecki ..... E04B 2/7457 52/241
6,568,138 B1 * 5/2003 Frost ..... E04B 2/767 52/241
6,647,691 B2 * 11/2003 Becker ..... E04B 2/7457 403/242

(Continued)

*Primary Examiner* — Brent W Herring
(74) *Attorney, Agent, or Firm* — Ashkan Najafi

(57) ABSTRACT

A support wall frame system includes an end track, and a metal frame member received within the end track. The metal frame member includes a plurality of ribs and a plurality of stiffeners spaced therefrom, respectively. The plurality of ribs are statically affixed to the end track, and the plurality of stiffeners are abutted against the end track. An inwardly directed V-shaped stiffener is located along base while each side wall has an inwardly directed rib. Each end of the stud is received within the end track such that the end track has a base with upwardly directed side walls, these side walls each having an inwardly directed detent. The stud is friction held between the end track's side walls and each detent is received within a respective one of the ribs to lock the stud. Fasteners pass through each -detent-rib pair.

10 Claims, 13 Drawing Sheets

(56) References Cited

U.S. PATENT DOCUMENTS

| | | | | |
|---|---|---|---|---|
| 7,178,304 | B2 * | 2/2007 | Brady | E04B 2/7457 52/481.1 |
| 7,223,043 | B1 * | 5/2007 | Andrews | E04B 2/766 403/230 |
| 7,730,695 | B2 * | 6/2010 | Brady | E04B 2/7457 52/696 |
| 7,770,348 | B2 * | 8/2010 | Tollenaar | E04B 2/767 52/241 |
| 7,849,640 | B2 * | 12/2010 | Rice | E04B 2/7457 33/483 |
| 8,061,099 | B2 * | 11/2011 | Andrews | E04B 2/7457 52/243.1 |
| 8,074,416 | B2 * | 12/2011 | Andrews | E04B 2/767 403/230 |
| 8,281,544 | B2 * | 10/2012 | Brady | E04B 2/7457 52/696 |
| 8,733,044 | B2 * | 5/2014 | Dollerup | E04B 2/7457 52/290 |
| 2004/0074200 | A1 | 4/2004 | Attalla | |
| 2005/0166524 | A1 | 8/2005 | Attalla | |
| 2006/0144009 | A1 | 7/2006 | Attalla | |
| 2007/0011971 | A1 * | 1/2007 | Sitkiewicz | E04B 2/767 52/481.1 |
| 2008/0110126 | A1 * | 5/2008 | Howchin | E04C 3/07 52/630 |
| 2008/0168733 | A1 * | 7/2008 | Tollenaar | E04B 2/767 52/481.1 |
| 2008/0250738 | A1 * | 10/2008 | Howchin | E04B 2/789 52/235 |
| 2017/0254081 | A1 * | 9/2017 | Castellucci | B21D 5/08 |

* cited by examiner

SUPPORT WALL FRAME SYSTEM AND ASSOCIATED USE THEREOF

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to stick-built construction frame systems and, more particularly, to a support wall frame system including at least one end track and a frame member connected thereto, wherein the frame member has a series of ribs and stiffeners to increase its shear strength so that the frame member resists twisting thereby preventing racking of the support wall.

Prior Art

Stick frame construction or simply stick construction is used for a large portion of the frame of a building, is used in a large percentage of smaller scale building construction projects. Stick construction utilizes studs, lightweight materials, typically either wood or metal, to construct the frame, including walls, floor joists and roof trusses of the building under construction, wood studs being typical in residential construction and metal studs being typical in commercial construction. Stick frame construction produces a building frame that has a relatively high strength to weight ratio.

While a strong frame can be produced using standard stick frame construction, there is room for improvement. One issue building design engineers grapple with is trying to increase the shear strength of the frame built, especially, the vertical or wall components of the frame. A stick frame constructed building is subject to in plane lateral forces, caused by wind and earthquakes. If such in plane force is sufficiently strong, the building can be subject to racking, wherein the walls of the building come out of square. Racking causes damage to carious components of the building, including the walls, both interior and exterior, cabinets, doors and windows, flooring, especially upper story flooring, and in extreme cases, structural failure.

In wood stick frame construction, engineers focus on the strength of the wood used to produce the stud as well as bracing the frame and the walls via sheathing and other methods, in order to increase the shear strength of the structure built in order to thereby reduce the potential for racking. In addition to these considerations, in metal stick construction, engineers also focus on the geometry of the frame, particularly the stud, to increase the overall shear strength of the stud and thereby increase overall shear strength of the frame produced.

Accordingly, a need remains for a frame system in order to overcome at least one aforementioned shortcoming. The exemplary embodiment(s) satisfy such a need by providing a support wall frame system including a frame member having a series of ribs and stiffeners and at least one end track connected to the frame member, that is convenient and easy to use, lightweight yet durable in design, versatile in its applications, and designed for increasing the frame members shear strength so that the frame member resists twisting and prevents racking of the support wall. The present disclosure provides non-obvious improvements to the subject matter disclosed in U.S. Pat. No. 5,315,804 and U.S. Published Patent Application Nos. US20040074200A1, US20050166524A1, and US20060144009A1, which were filed by the applicant of the present application.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a metal stud to be used in stick frame construction wherein the geometry of the stud, as well as the receiving portion of the end track that receives the stud, are designed to increase the shear strength of the stud and thus the overall support wall produced, for a given material used to produce the stud. These and other objects, features, and advantages of the non-limiting exemplary embodiment(s) are provided by a support wall frame system for providing increased shear strength thereby preventing twisting and racking of a support wall. Such a support wall frame system advantageously includes a metal frame member that is of relatively simple design and construction, being produced using standard manufacturing techniques, so that the metal frame stud is economically attractive to potential consumers for this type of product. Use of the metal frame member is relatively straightforward requiring only the standard skills application to metal stick frame. Special tools to produce the frame using the metal frame member of the present invention are not required.

In a non-limiting exemplary embodiment, the support wall frame system includes at least one end track, and a frame member received within the at least one end track. The frame member includes a plurality of ribs and a plurality of stiffeners spaced therefrom, respectively. The plurality of ribs are statically affixed to the at least one end track, and the plurality of stiffeners are abutted against the at least one end track.

In a non-limiting exemplary embodiment, the frame member has a single and unitary metal body.

In a non-limiting exemplary embodiment, the metal frame member includes an elongate stud that has a stud base with a first stud side wall extending upwardly from a first end of the stud base and a second stud side wall extending upwardly from an opposing second end of the base. The first stud side wall and the second stud side wall are coextensive and parallel with each other and each is oriented in perpendicular fashion with respect to the stud base. At least one inwardly directed first rib is located along a first length of the first stud side wall while at least one inwardly directed second rib is located along a second length of the second stud side wall. An end of the stud is received within an end track.

In a non-limiting exemplary embodiment, the at least one end track includes a bottom end track and a top end track, each including a track base that has a first track side wall extending upwardly from a first side of the track base and a second track side wall extending upwardly from a second side of the track base. The first track side wall has an inwardly directed first detent and the second track side wall has a second inwardly directed detent. The stud is disposed between the first track side wall and the second track side wall such that the first detent is received within the first rib and the second detent is received within the second rib. A first return leg extends inwardly from a first distal end of the first stud side wall while a second return leg extends inwardly from a second distal end of the second stud side wall. The first return leg and the second return leg are substantially similar in length to one another, are each oriented in perpendicular fashion with respect to the first stud side wall and the second stud side wall and are each oriented in parallel fashion with respect to the stud base.

In a non-limiting exemplary embodiment, a first flange extends downwardly from a third distal end of the first return leg while a second flange extends downwardly from a fourth distal end of the second return leg. The first flange and the second flange are substantially similar in length to one another, are each oriented in perpendicular fashion with respect to the first return leg and the second return leg and are each oriented in parallel fashion with respect to the first stud side wall and the second stud side wall. At least one inwardly directed stiffener is located along a third length of the base.

In a non-limiting exemplary embodiment, the stiffener is generally V-shaped. The first rib and the second rib are each generally U-shaped. The stud base, the first stud side wall, and the second stud side wall are each integral with one another, being formed from a single and continuous sheet or section of material. At least one first fastener passes through the first detent and the first rib while a second fastener passes through the second detent and the second rib. The stud has a width with a first dimension and the end track has an inside diameter with a second dimension that is substantially similar to the first dimension.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
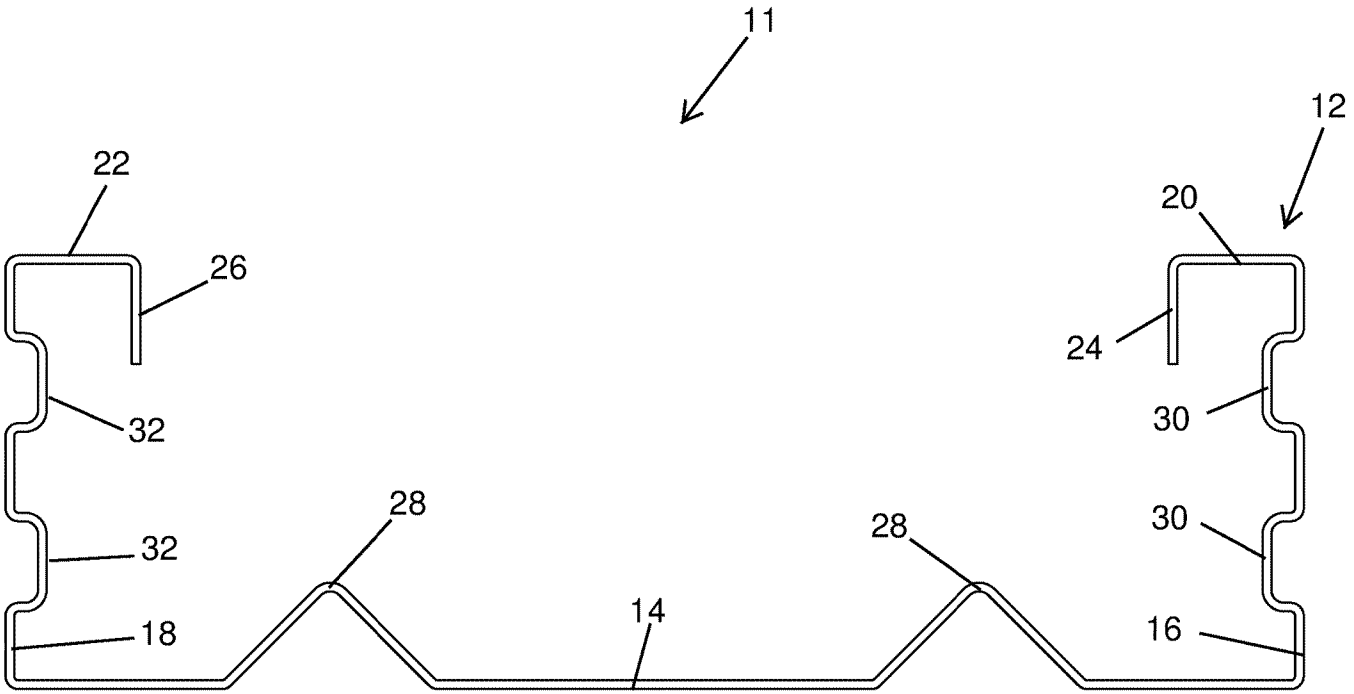
FIG. 1 is a top plan view of a metal frame member of a support wall frame system, in accordance with a non-limiting exemplary embodiment of the present disclosure.
Figure 2:
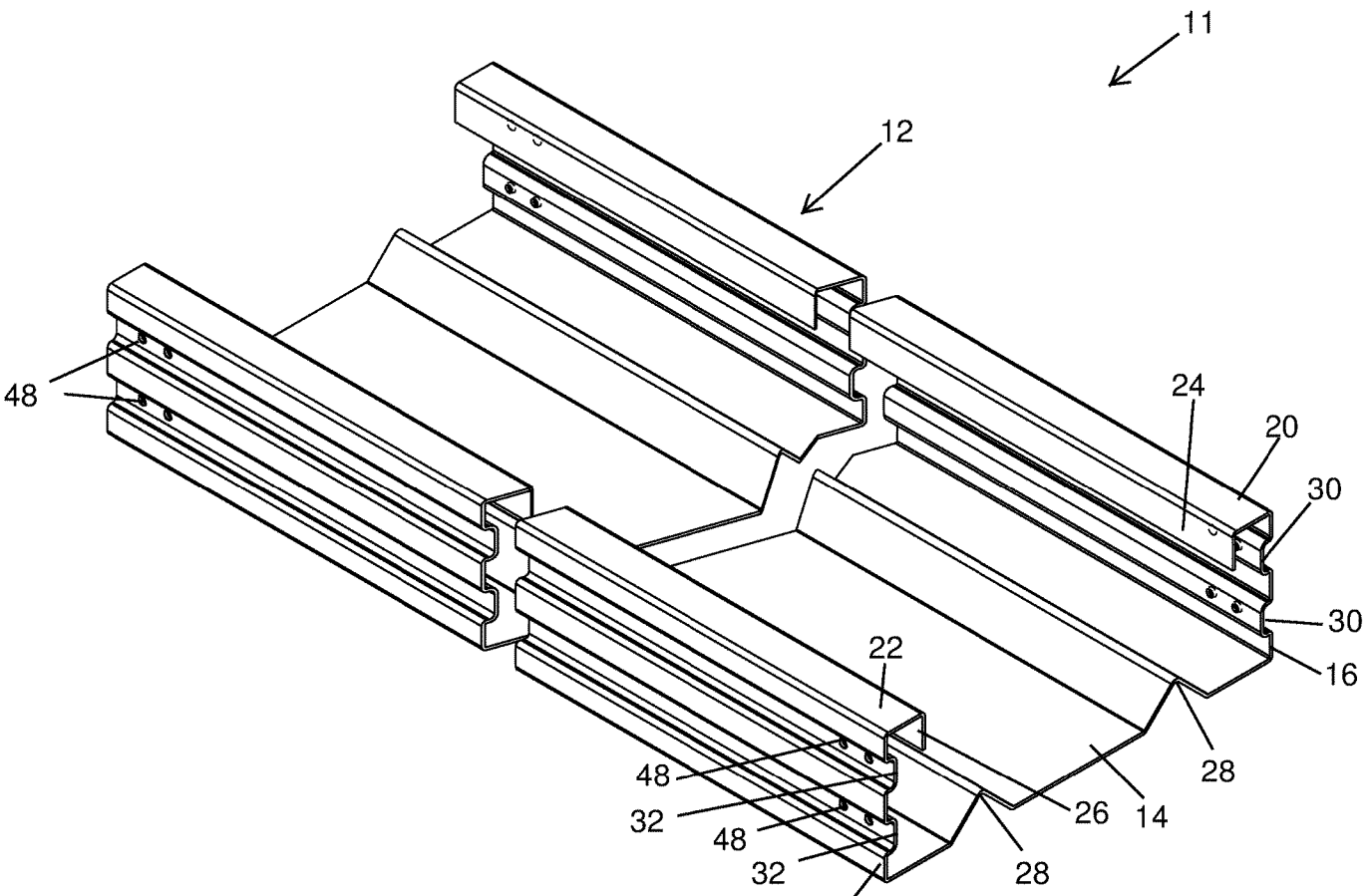
FIG. 2 is a perspective view of a metal frame member.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-15A and is/are intended to provide a support wall frame system 10 including at least one end track 34 and a frame member 11 connected thereto. Such a frame member 11 has a series of ribs 30, 32 and stiffeners 28 to increase its shear strength so that the frame member 11 resists twisting thereby preventing racking of the support wall 60.

In a non-limiting exemplary embodiment, the at least one end track 34 can be matched with the ribs 30, 32 for providing a predetermined layout configuration so the user knows which frame member 11 should be attached to each section of the at least one end track 34. This will simplify the framing installation process. Use of the ribs 30, 32 increases the axial load capacity. Such ribs 30, 32 are specially designed to accommodate fasteners to fit flush metal to metal without undesirable separation.

In a non-limiting exemplary embodiment, the frame member 11 may also have the fold down knockout for bracing while permitting electrical and plumbing components to pass therethrough. As perhaps best shown in FIGS. 10 and 15-15A, a bottom end track 34 and top end track 34*a* preferably have matching detents 42, 44 to interlock the stud 12 at ribs 30, 32. By having a plurality of ribs 30, 32 seated at opposed top and bottom ends of stud 12, the stud 12 is prohibited from undesirably rotating or twisting once fastened in place to end tracks 34, 34*a*. Such a structural configuration provides two or more connections at the top and bottom ends of stud 12, thereby adding to pull out and shear resistance forces. The unexpected and unpredictable result provides an anti-racking support wall frame system 10 that keeps the support wall 60 square, without requiring heavier gauge studs to be employed.

In a non-limiting exemplary embodiment, the present disclosure overcomes the need to provide reinforcement straps while providing higher shear resistance values. However, if desired, the reinforcement straps may be employed if desired.

In a non-limiting exemplary embodiment, as perhaps best shown in FIGS. 10 and 13-15A, the metal support wall frame system 10 includes at least one end track (e.g., bottom end 34 and top end track 34*a*), and a frame member 11 received within the at least one end track 34. The frame member 11 includes a plurality of ribs 30, 32 and a plurality of stiffeners 28 spaced therefrom, respectively. The plurality of ribs 30, 32 are statically affixed to the at least one end track 34, and the plurality of stiffeners 28 are abutted against the at least one end track 34. For example, as perhaps best shown in FIGS. 14 and 14*a*, stiffeners 28 engage and extend between a bottom end track 34 and a top end track 34*a*.

In a non-limiting exemplary embodiment, the frame member 11 has a single and unitary metal body.

With reference to FIGS. 1-8, in a non-limiting exemplary embodiment, frame member 11 includes a stud 12 that has stud base 14 that has a first stud side wall 16 extending upwardly from one end of the stud base 14 and a second stud side wall 18 extending upwardly from an opposing end of the stud base 14, the two side walls 16 and 18 being coextensive and parallel with one another and being perpendicularly oriented with respect to the stud base 14. A first return leg 20 extends inwardly from the distal end of the first stud side wall 16 while a second return leg 22 extends inwardly from the distal end of the second stud side wall 18. The first return leg 20 and the second return leg 22 are each substantially similar in length are perpendicularly oriented with respect to their respective side wall 16 and 18, and are substantially parallel with the stud base 14.

In a non-limiting exemplary embodiment, an optional first flange 24 extends downwardly from the end of the first return leg 20 while an optional second flange 26 extends downwardly from the end of the second return leg 22. The first flange 24 and the second flange 26 are each substantially similar in length are perpendicularly oriented with respect to their respective return leg 20 and 22, and are substantially parallel with the first stud side wall 16 and the second stud side wall 18.

In a non-limiting exemplary embodiment, a pair of stiffeners 28 is located along the stud base 14 in spaced apart fashion, each stiffener being a generally V-shaped member that protrudes inwardly into the metal frame member 10 toward the first return leg 20 and the second return leg 22. Although two stiffeners 28 are illustrated, the use of a single stiffener or more than two stiffeners is also possible.

In a non-limiting exemplary embodiment, a first pair of inwardly directed, generally U-shaped ribs 30 is located along the first stud side wall 16 while a second pair of inwardly directed, generally U-shaped ribs 32 is located along the second stud side wall 18.

In a non-limiting exemplary embodiment, the metal frame member 10 is substantially symmetrical about a vertical axis that passes in perpendicular fashion, through the midpoint of the stud base 14.

Figure 9:
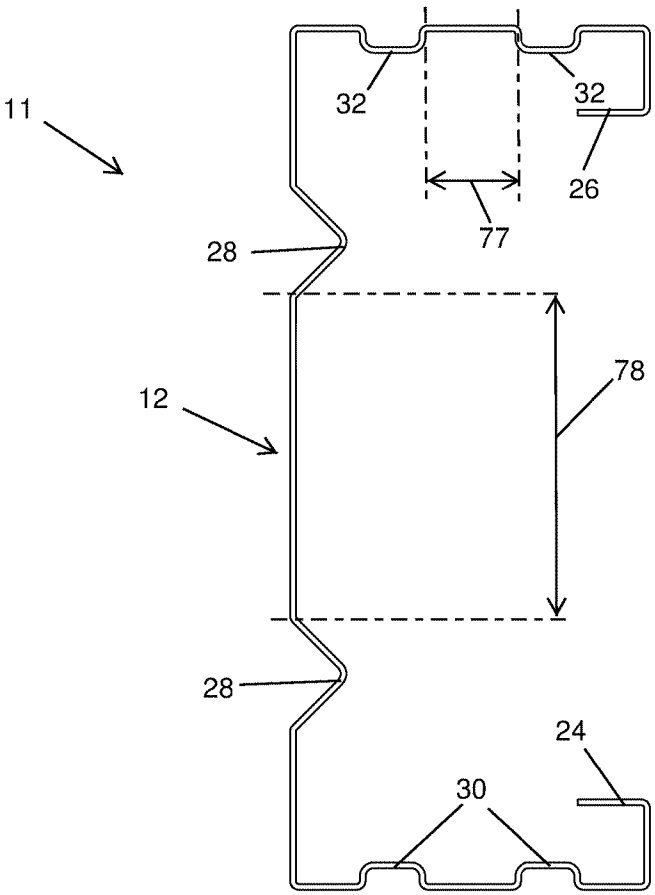
FIG. 9 is a top plan view of a metal frame member having ribs and stiffeners spaced apart at alternate distances relative to FIG. 1, respectively, in accordance with a non-limiting exemplary embodiment of the present disclosure.
Figure 10:
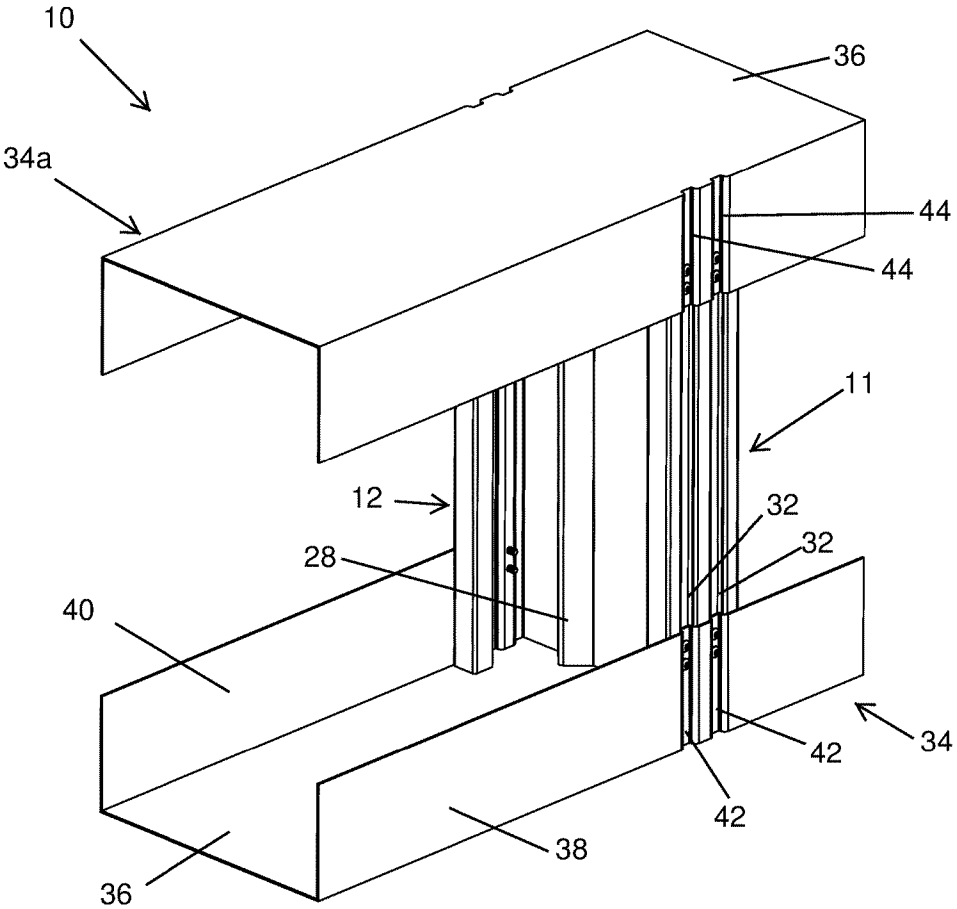
FIG. 10 is a perspective view of support wall frame system including a metal frame member intercalated between a top end track and a bottom end track, in accordance with a non-limiting exemplary embodiment of the present disclosure.
Figure 11:
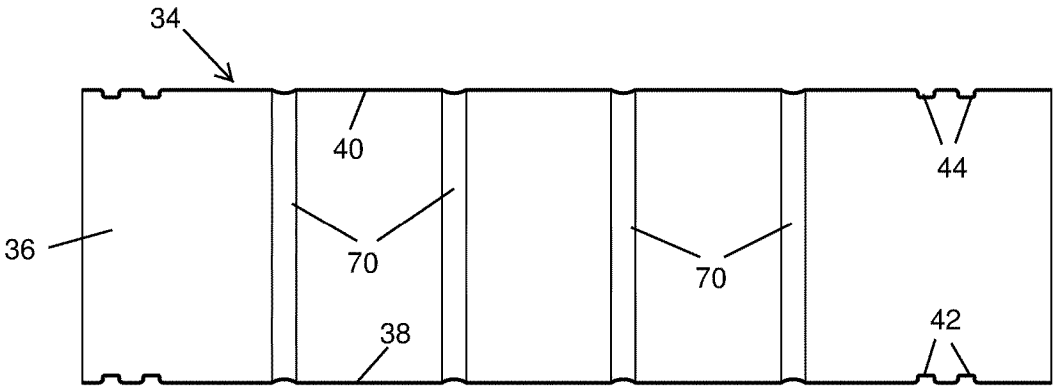
FIG. 11 is a top plan view of at least one end track wherein the ribs continuously extend along both side walls and a bottom surface, in accordance with a non-limiting exemplary embodiment of the present disclosure.
Figure 12:
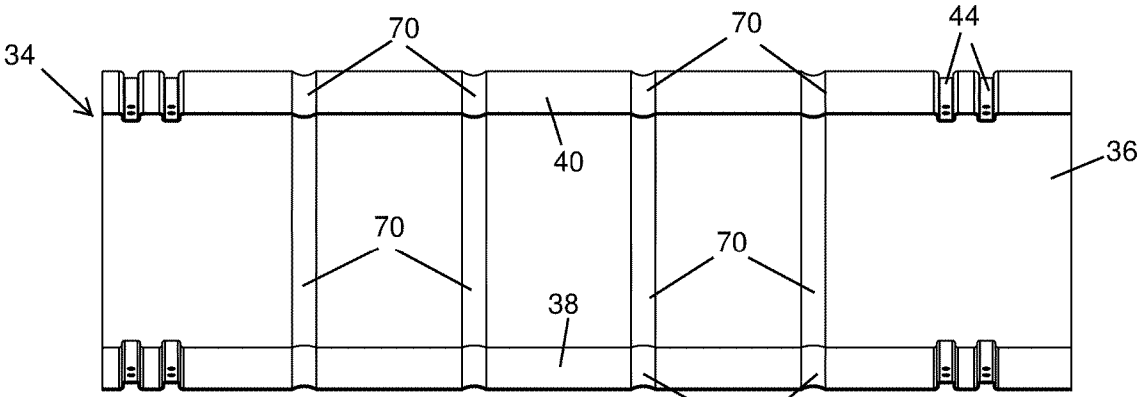
FIG. 12 is a perspective view of the at least one end track shown in FIG. 11.
Figure 13:
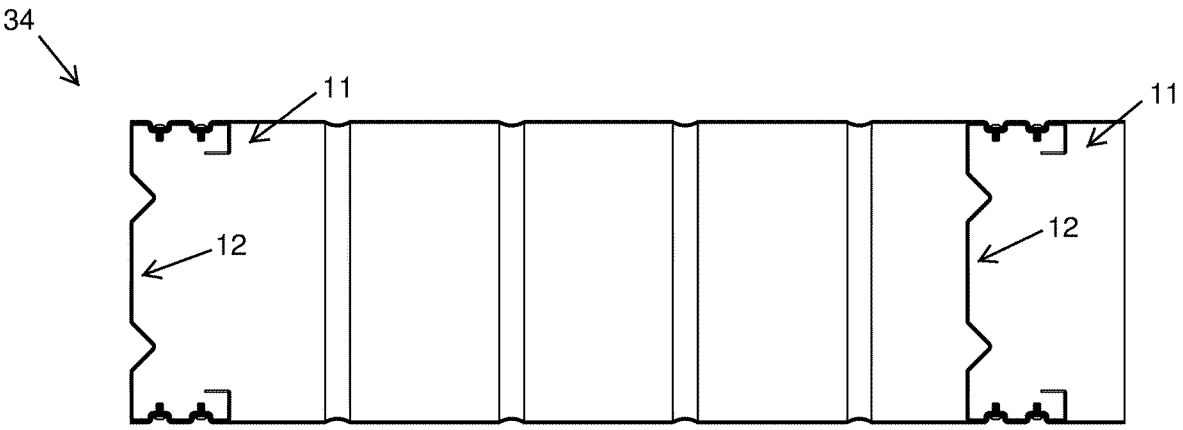
FIG. 13 is a top plan view showing a plurality of metal frame members attached to at least one end track shown in FIG. 12.
Figure 14:
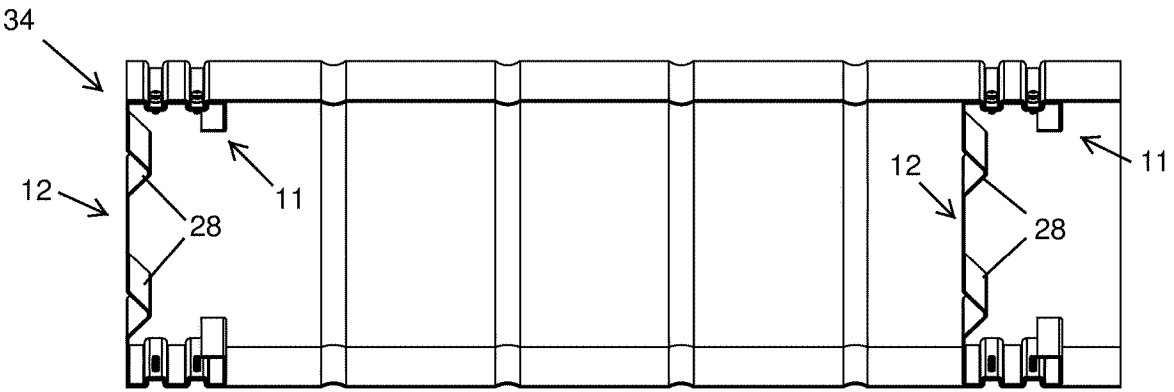
FIG. 14 is a perspective view showing the plurality of metal frame members attached to at least one end track shown in FIG. 13.
Figure 15A:
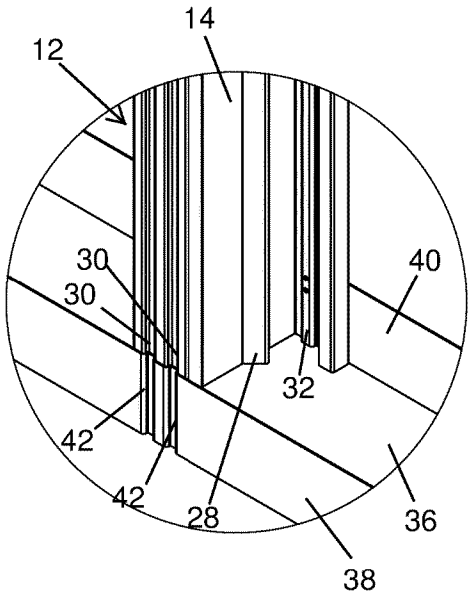
FIG. 15A is an enlarged view of section 15A taken in FIG. 15.
Figure 15:
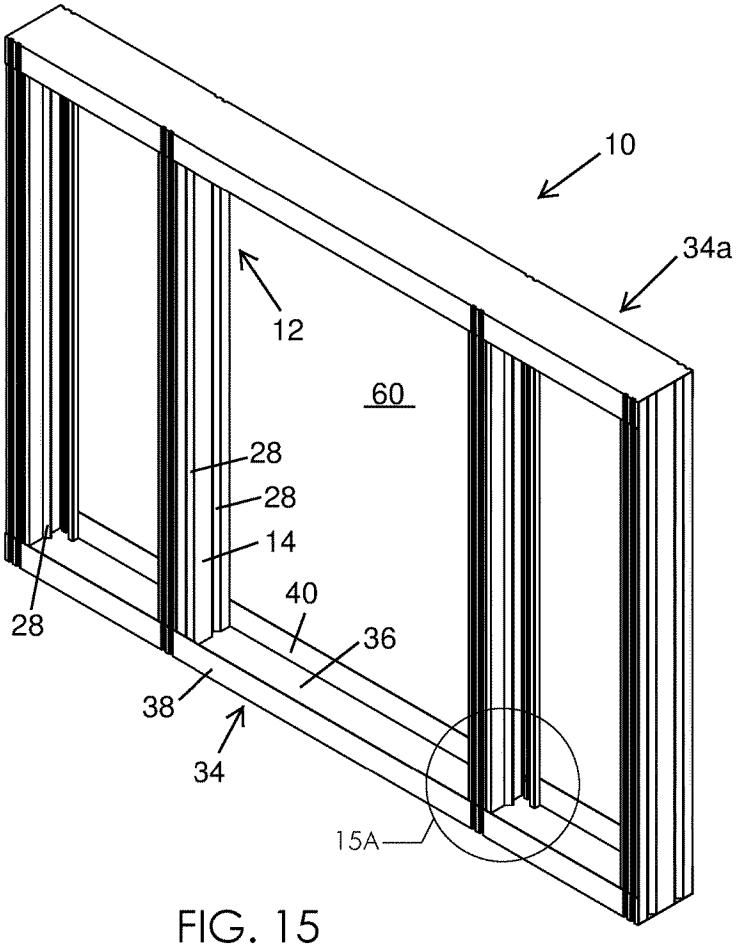
FIG. 15 is an environmental view of a support wall frame system employed in a support wall structure wherein the support wall frame system includes a metal frame member intercalated between a top end track and a bottom end track, in accordance with a non-limiting exemplary embodiment of the present disclosure.

Advantageously, the entire metal frame member 10 is formed from a single, integral, and continuous sheet of metal, such aluminum, steel, and the like, and is formed into the particular geometry using an appropriate manufacturing technique (stamping, extrusion, roll forming, etc.,). The size of a particular metal frame member 10, including the length, width, depth and gauge of metal used is dependent on the job at hand is engineered accordingly. For example, FIG. 9 is a top plan view of a metal frame member 11 having ribs 30, 32 and stiffeners 28 spaced apart at alternate distances 77, 78 relative to the embodiment illustrated in FIG. 1, respectively, in accordance with a non-limiting exemplary embodiment of the present disclosure.

Ideally, each corner of the stud 12 is radiused to help prevent cutting injuries to workers handling the stud 12 while the end of each flange 24 and 26, if used, and if not, the end of each return leg 20 an 22 is appropriately finished, again to help prevent cutting injuries to workers handling the stud 12.

Figure 3:
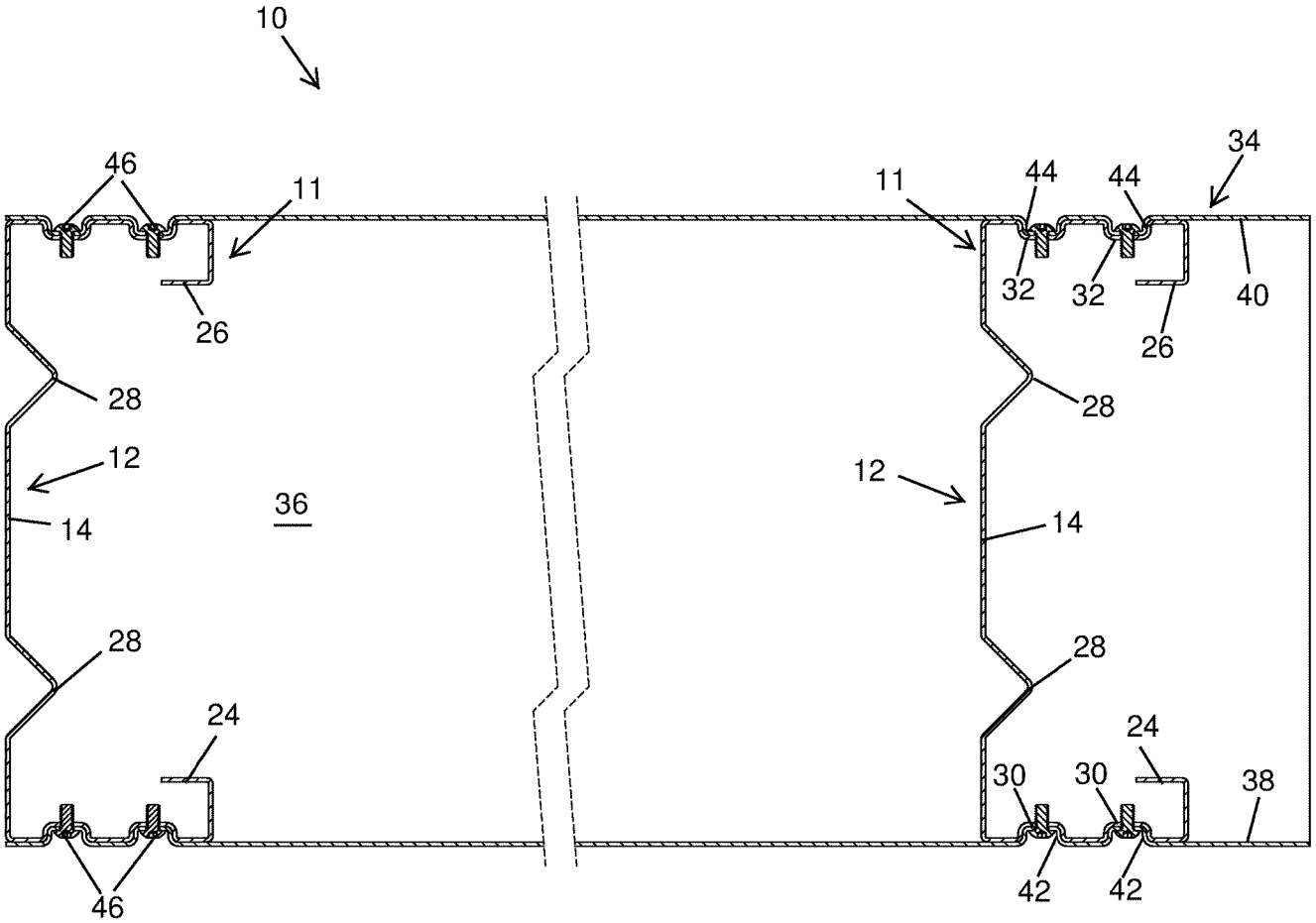
FIG. 3 is a cross-sectional view of a plurality of juxtaposed metal frame members affixed to at least one end track.
Figure 4:
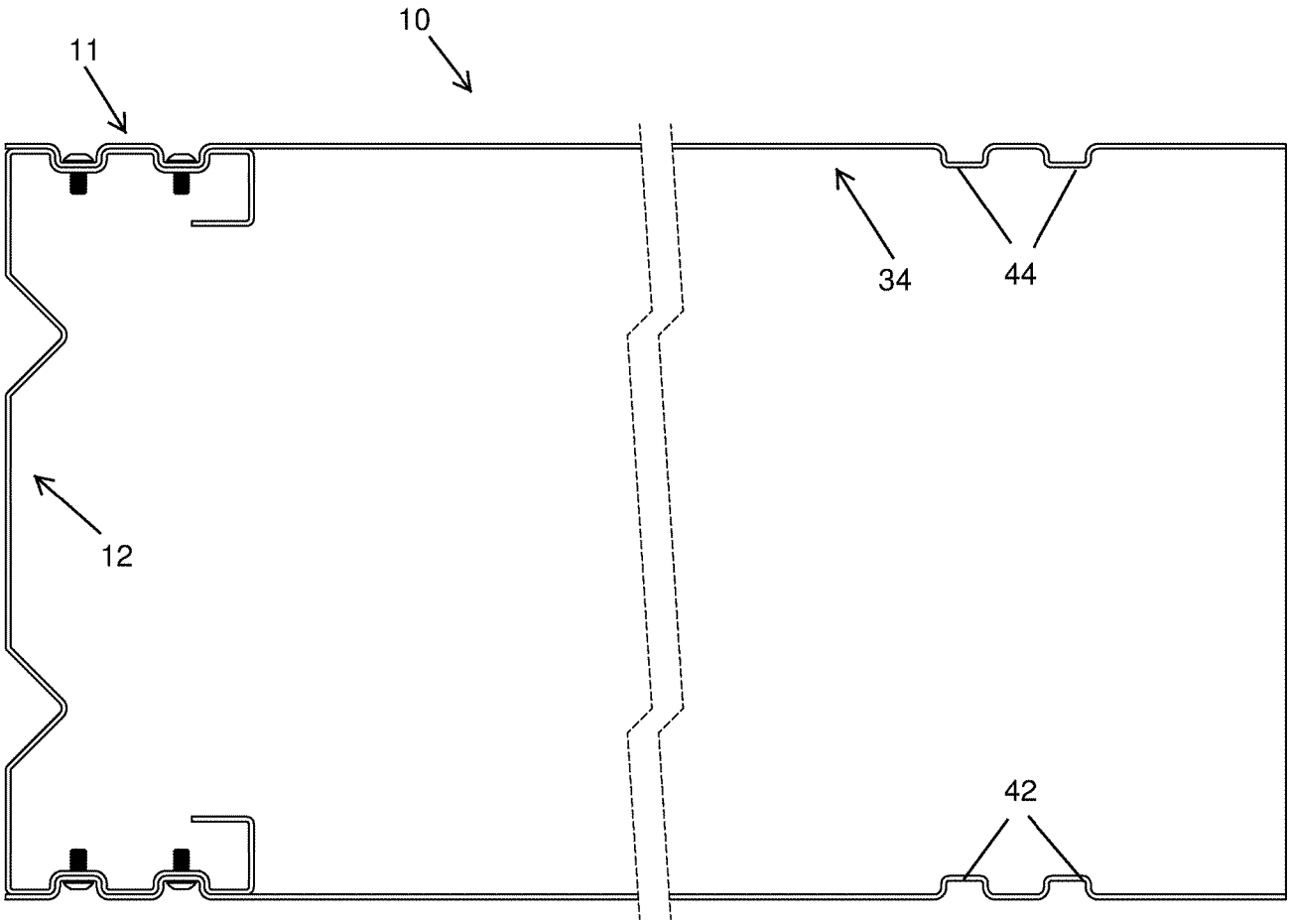
FIG. 4 is a top plan view of a metal frame member affixed to a lateral region of at least one end track.
Figure 5:
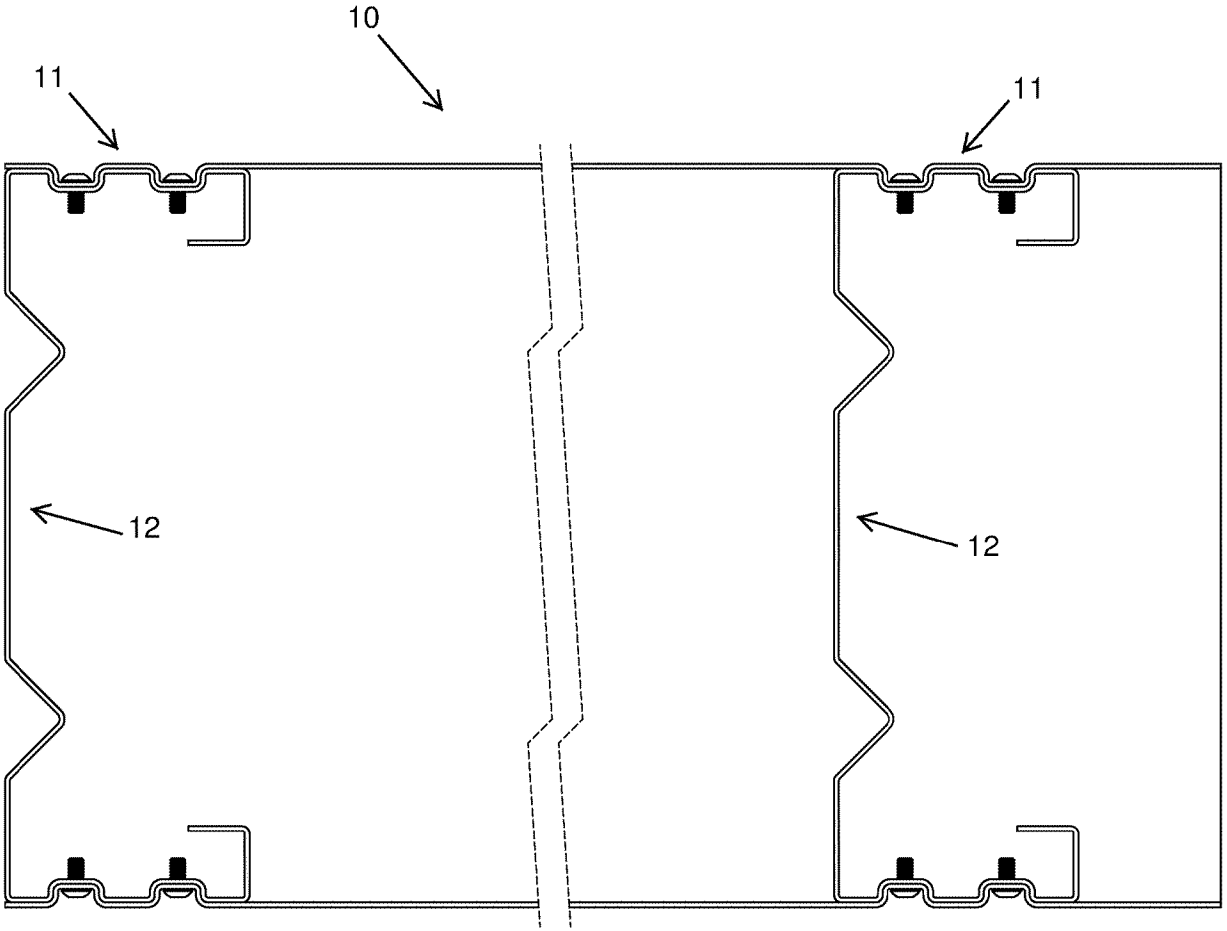
FIG. 5 is a top plan view of a plurality of juxtaposed metal frame members affixed to at least one end track.
Figure 6:
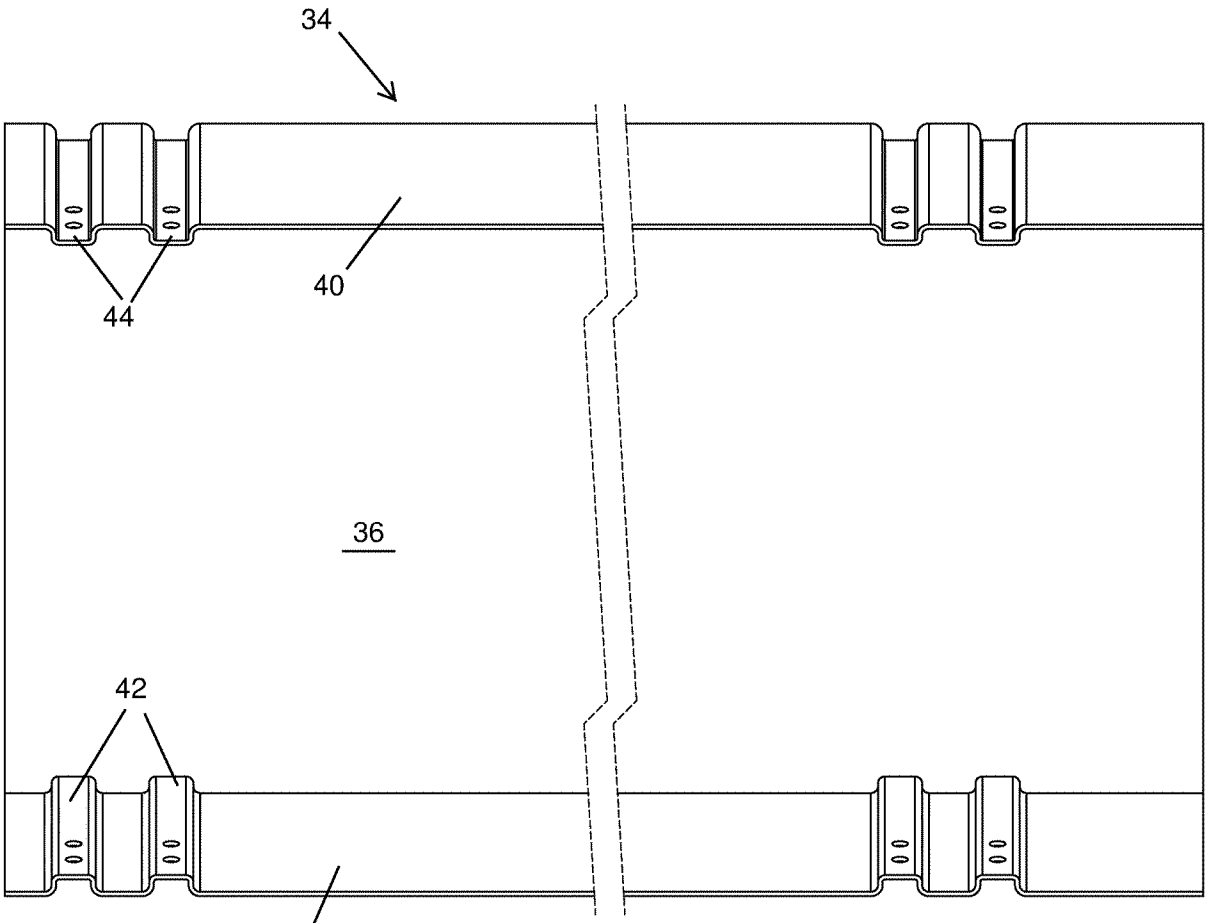
FIG. 6 is a perspective view of at least one track.
Figure 7:
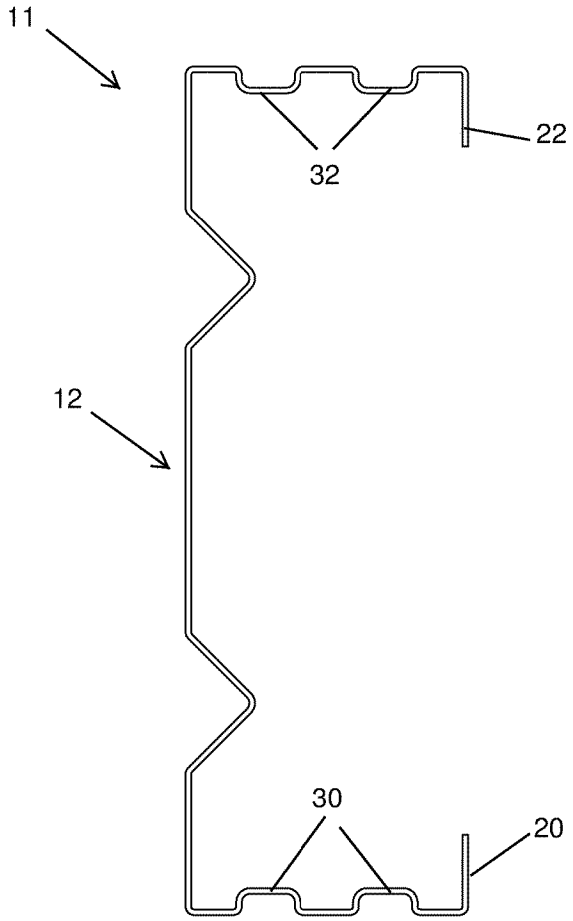
FIG. 7 is a top plan view of a metal frame member not including the optional first flange and optional second flange, in accordance with a non-limiting exemplary embodiment of the present disclosure.
Figure 8:
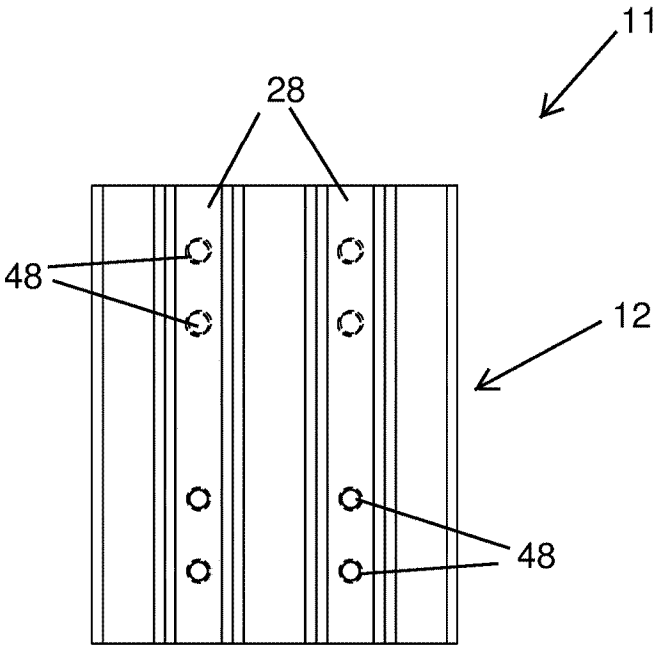
FIG. 8 is a reduced side elevational view of a metal frame member.

In a non-limiting exemplary embodiment, as seen in FIG. 3, an end track 34 is provided. The end track 34 is a typical end track used in metal stick frame construction, modified to utilize the features of the stud 12. Specially, the end track 34 has a track base member 36 from which a first track side wall 38 and a second track side wall 40 each extend upwardly from either end of the base member 36 a small distance. The first track side wall 38 and a second track side wall 40 are each coextensive and parallel with one another are each oriented in perpendicular fashion relative to the track base 36. The distance between the inside surface of the first track side wall 38 and the inside surface of the second track side wall 40 is substantially similar to the distance between the outside surface of the first stud side wall 16 and the outside surface of the second stud side wall 18.

In a non-limiting exemplary embodiment, a series of first inwardly directed detent pairs 42 is located along the first track side wall 38 while a series of second inwardly directed detent pairs 44 is located along the second track side wall 40. Each first detent pair 42 is located directly across from a respective one of the second detent pairs 44. The spacing between each first detent pair 42, and thus the second detent pair 44, is based on the particular frame being built such as 18 inches spacing for 18 inches on center stud construction as is known in the art.

With reference to FIGS. 11-14, in a non-limiting exemplary embodiment, the at least one end track 34 has additional juxtaposed detents 70 continuously extended along both side walls 38, 40 and base 36. Thus, each metal frame member 11 could include corresponding ribs 30, 32 and stiffeners 28 that interconnect within such detents 70 along both side walls 38, 40 and base 36 of the end track 34. It is noted that although such detents 70 are shown as having a generally single concave cross-section, the cross-section of such detents 70 can vary and will match the profile of the bottom and top ends of stud 12 so that they complement each other and provide a secure interconnection (e.g., corresponding tongue/groove or male/female configuration). Such detents 70 continuously extend across base 36 thereby providing additional balance and distribution of material without over stretching. Such a configuration increases the strength and maximum axial force without allowing the stud 12 to twist. Optionally, one or more detents 70 traveling across base 36 may be employed.

In order to install a stud 12 within the end track 34, an end of the stud 12 is placed into the end track 34 to that each first rib 30 receives a respective one of the first detents 42 of the end track 34 and each second rib 32 receives a respective one of the second detents 44 of the end track 34. As the width of the stud 12 (distance between outer surface of first side wall 16 and the outer surface of the second side wall 18) is substantially similar to the inside diameter (distance between the inner surface of the first track side wall 38 and the inner surface of the second track side wall 40), the stud 12 is generally friction held in place. The first detents 42 received within the first ribs 30 and the second detents 44 received within the second ribs 32 help lock the stud 12 in place within the end track 34.

Appropriate fasteners 46 are passed through each first rib-first detent pair and through each second rib-second detent pair to firmly attach the stud 12 to the end track 34. The fasteners 46 can be self-tapping or openings 48 can be pre-punched within each first rib 30 and each second rib as well as within each first detent 42 and each second detent 44. The rib-detent combination is dimensioned so that the installed fastener 46 is at best flush with the outer surface of the end track 34 (or countersunk as illustrated) for each of attaching appropriate sheathing to either side of the frame built. The detent-rib locking helps prevent stud 12 twisting within the end track 34, which tends to occur in conventional systems, especially after one side of the stud 12 is fastened to the end track 34. Each stud 12 is fastened to an end track 34 on either end of the stud 12.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. § 1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A support wall frame system for providing increased shear strength thereby preventing twisting and racking of a support wall, said support wall frame system comprising:

at least one end track; and a frame member received within said at least one end track, said frame member including a plurality of ribs and a plurality of stiffeners spaced therefrom, respectively;

wherein said ribs are statically affixed to said at least one end track;

wherein said stiffeners are abutted against said at least one end track;

wherein said frame member comprises an elongate stud having a stud base with a first stud side wall extending upwardly from a first end of said stud base and a second stud side wall extending upwardly from an opposing second end of said base, said first stud side wall and said second stud side wall being coextensive and parallel with each other and each being oriented in perpendicular fashion with respect to said stud base;

wherein said at least one end track comprises a bottom end track and a top end track, each including a track base having a first track side wall extending upwardly from a first side of said track base and a second track side wall extending upwardly from a second side of said track base, said first track side wall having an inwardly directed first detent and said second track side wall having a second inwardly directed detent;

wherein said ribs comprise an inwardly directed first rib extending along a first length of said first stud side wall, an inwardly directed second rib extending along a second length of said second stud side wall, and wherein a third end of said stud is adapted to be received within said at least one end track such that said stud is disposed between said first track side wall and said second track side wall and such that said first detent is received within said first rib and said second detent is received within said second rib wherein said frame member further comprises:

a first fastener passing through said first detent and said first rib; and a second fastener passing through said second detent and said second rib.

2. The support wall frame system of claim 1, wherein said frame member has a single and unitary metal body.

3. The support wall frame system of claim 2, wherein said frame member further comprises:

a first return leg extending inwardly from a first distal end of said first stud side wall;

a second return leg extending inwardly from a second distal end of said second stud side wall; and wherein said first return leg and said second return leg are substantially similar in length to one another, are each oriented in perpendicular fashion with respect to said first stud side wall and said second stud side wall and are each oriented in parallel fashion with respect to said stud base.

4. The support wall frame system of claim 3, wherein said frame member further comprises:

a first flange extending downwardly from a third distal end of said first return leg;

a second flange extending downwardly from a fourth distal end of said second return leg; and wherein said first flange and said second flange are substantially similar in length to one another, are each oriented in perpendicular fashion with respect to said first return leg and said second return leg and are each oriented in parallel fashion with respect to said first stud side wall and said second stud side wall.

5. The support wall frame system of claim 4, wherein said frame member further comprises: an inwardly directed stiffener located along a third length of said base.

6. The support wall frame system of claim 5, wherein said stiffener is generally V-shaped.

7. The support wall frame system of claim 6, wherein said first rib and said second rib are each generally U-shaped.

8. The support wall frame system of claim 7, wherein said stud base, said first stud side wall, and said second stud side wall are each integral with one another, being formed from a single and continuous sheet or section of material.

9. The support wall frame system of claim 8, wherein said stud has a width with a first dimension and said at least one end track has an inside diameter with a second dimension that is substantially similar to said first dimension.

10. A support wall frame system for providing increased shear strength thereby preventing twisting and racking of a support wall, said support wall frame system comprising:

at least one end track;

a frame member including a plurality of ribs and a plurality of stiffeners spaced therefrom, respectively;

wherein said plurality of ribs are statically affixed to said at least one end track;

wherein said plurality of stiffeners are abutted against said at least one end track;

wherein said frame member includes an elongate stud having a stud base with a first stud side wall extending upwardly from a first end of said stud base and a second stud side wall extending upwardly from an opposing second end of said base, said first stud side wall and said second stud side wall being coextensive and parallel with each other and each being oriented in perpendicular fashion with respect to said stud base;

wherein said at least one end track comprises a bottom end track and a top end track, each including a track base having a first track side wall extending upwardly from a first side of said track base and a second track side wall extending upwardly from a second side of said track base, said first track side wall having an inwardly directed first detent and said second track side wall having a second inwardly directed detent, wherein each detent extends the entire width of each respective side wall;

wherein said ribs comprise an inwardly directed first rib extending along a first length of said first stud side wall, an inwardly directed second rib extending along a second length of said second stud side wall, and wherein a third end of said stud is adapted to be received within said at least one end track such that said stud is disposed between said first track side wall and said second track side wall and such that said first detent is received within said first rib and said second detent is received within said second rib.

* * * * *